US008824955B2

(12) United States Patent
Moran

(10) Patent No.: US 8,824,955 B2
(45) Date of Patent: Sep. 2, 2014

(54) SIMPLIFIED APPARATUS FOR POSITIVELY PREVENTING THE USE OF MOBILE PERSONAL COMMUNICATION DEVICES

(76) Inventor: Martin Moran, Wethersfield, CT (US)

( * ) Notice: Subject to any disclaimer, the term of this patent is extended or adjusted under 35 U.S.C. 154(b) by 0 days.

(21) Appl. No.: 13/068,226

(22) Filed: May 6, 2011

(65) Prior Publication Data

US 2014/0106662 A1 Apr. 17, 2014

(51) Int. Cl.
*H04K 3/00* (2006.01)

(52) U.S. Cl.
CPC ..... *H04K 3/415* (2013.01)
USPC ..... 455/1; 455/569.2

(58) Field of Classification Search
CPC ..... H04W 48/02; H04W 4/027
USPC ..... 455/1, 569.2
See application file for complete search history.

(56) References Cited

U.S. PATENT DOCUMENTS

2008/0268768 A1* 10/2008 Brown et al. ..... 455/1

* cited by examiner

*Primary Examiner* — Tu X Nguyen
(74) *Attorney, Agent, or Firm* — McCormick, Paulding & Huber LLP

(57) ABSTRACT

A simplified apparatus for positively preventing the use of mobile personal communication devices by the operator of a vehicle comprises a motion responsive device in the vehicle, switching means operable by the device when the vehicle is in motion, a signal jammer operable by the switching means to block at least one of the incoming or outgoing signals associated with communication device when the vehicle is in motion, and a power supply for the jammer.

5 Claims, 1 Drawing Sheet

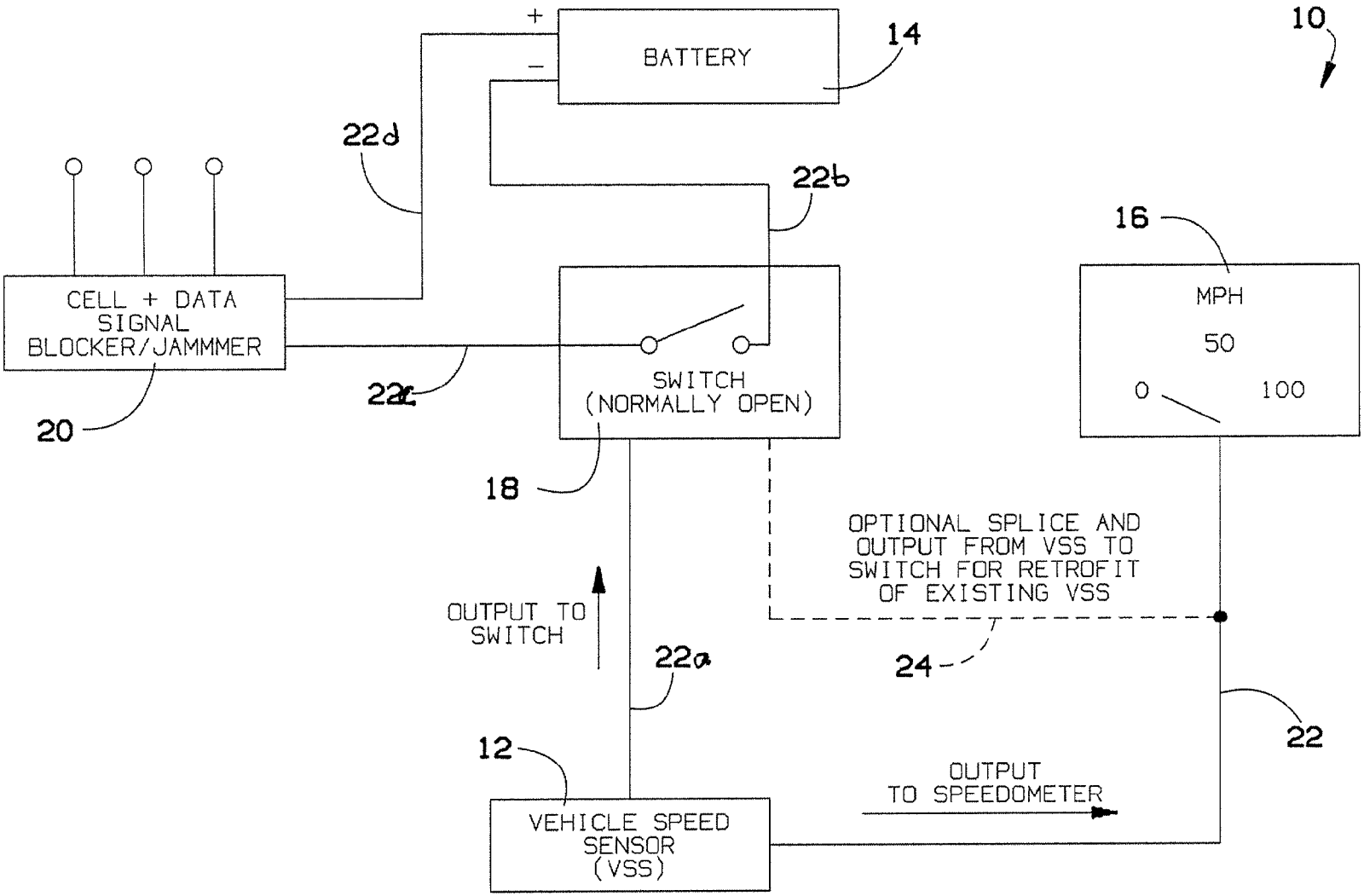
10
16
MPH
50
100
0
22
OPTIONAL SPLICE AND OUTPUT FROM VSS TO SWITCH FOR RETROFIT OF EXISTING VSS
24
OUTPUT TO SPEEDOMETER
14
BATTERY
+
−
22b
SWITCH (NORMALLY OPEN)
18
22a
OUTPUT TO SWITCH
VEHICLE SPEED SENSOR (VSS)
12
22d
22c
CELL + DATA SIGNAL BLOCKER/JAMMER
20

SIMPLIFIED APPARATUS FOR POSITIVELY PREVENTING THE USE OF MOBILE PERSONAL COMMUNICATION DEVICES

BACKGROUND OF THE INVENTION

The use of mobile personal communication devices has grown exponentially over the past several years and is ubiquitous at the present time. These devices fulfill very important needs for many people in providing instant communication with others at almost any location throughout the world as well as access to information from the Internet and other sources. The same devices can however also create life-threatening hazards when used in vehicles by the operator of the vehicle and when they result in distraction of the operator and in serious accidents. As a result, the majority of states have now outlawed the use of mobile personal communication devices by the operators of vehicles and a number of prior art devices have been developed to disable such devices. The available prior art devices may be generally satisfactory but are in many instances complex in design and operation and thus readily disabled or overridden.

It is the general object of the present invention to provide a simplified and yet highly positive disabling apparatus for a personal mobile communication device used in a vehicle by the operator of the vehicle.

SUMMARY OF THE INVENTION

In fulfillment of the foregoing object and in accordance with the present invention, a simplified apparatus which positively prevents the use of a mobile personal communication device by the operator of a motor vehicle is provided and comprises a motion responsive sensor in the vehicle which senses vehicle speed, switching means operable by the sensor when the vehicle is in motion, a signal jammer operable by the switching means to block at least one of the incoming and outgoing signals associated with the mobile personal communication device when the vehicle is in motion, and a power supply for the jammer.

Preferably, the motion responsive sensor takes the form of a conventional speed sensor of the type found in current motor vehicles and which emits electrical pulses transmitted to the vehicle speedometer when the vehicle is in motion.

The switching means preferably comprises a simple normally open switch connected by electrical conduit means with the speed sensor and, on its output side, with the signal jammer.

The signal jammer may be of a conventional type and is preferably adapted to jam outgoing signals from the personal communication device. The jammer may be connected with the vehicle battery or may have an internal power supply so as to be less vulnerable to tampering.

DRAWINGS

The single FIGURE of the drawings is a schematic representation of the invention in block form.

DESCRIPTION OF THE PREFERRED EMBODIMENTS OF THE INVENTION

Referring to the single FIGURE of the drawings, the apparatus of the invention is indicated generally by the reference numeral 10. A motion responsive sensor is indicated at 12 and preferably takes the form of a vehicle speed sensor of a conventional type found on motor vehicles at the present time. The speed sensor emits signals in the form of electrical pulses with the frequency of the pulses dependant on the speed of the vehicle and transmits the signals to the vehicle speedometer 16 through electrical conduit means 22. Electrical conduit means 22*a* is also connected with the speed sensor 12 and extends to a switch means in the form of normally open switch 18. Electrical conduit means 22*b* and 22*c* respectively connect the switch 18 with the vehicle battery 14 and with signal jammer 20.

As will be apparent, electrical pulses emitted by the speed sensor in response to vehicle movement will not only operate the speedometer 16 but will also cause the normally open switch 18 to close thus energizing the signal jammer 20 in a simple and straightforward manner which is relatively foolproof and minimally subject to being disabled or overridden, as will be seen herein below.

The signal jammer 20, which acts to block at least one of the incoming and outgoing signals to the mobile personal communication device may be conventional and may be provided with a function whereby preselected areas can be blocked. Thus, the jammer may be operable to block only the area within the vehicle.

In an alternative embodiment of the invention and in a retrofit arrangement, the switch 18 may be connected with the electrical conduit means 22 which extends to the speedometer 16 by tapping into or splicing with the conduit means 22 as indicated by electrical conduit means 24. Operation of the apparatus is identical with that described above.

From the foregoing it will be apparent that a simplified and positively acting apparatus has been provided. A minimum number of access points are available to a potential invader who might attempt to disable or override the apparatus and it will be obvious that wiring in the apparatus may be readily hidden, armored or even duplicated. Similarly, the two added operating devices in the form of the switch and jammer may be hidden, disguised, etc. In contrast, complex prior art systems with many operating devices, software and a multitude of points of access may be relatively easily disabled or overriden by the owner of a vehicle or a mechanic.

The invention claimed is:

1. A simplified apparatus for positively preventing the use of mobile personal communication devices by the operator of a vehicle; said apparatus comprising:

a motion responsive sensor in the vehicle, switching means operable by the sensor when the vehicle is in motion, a signal jammer operable by the switching means to block at least one of the incoming and outgoing signals associated with the personal mobile communication device when the vehicle is in motion, and a power supply associated with the signal jammer, wherein the motion responsive device takes the form of a conventional vehicle speed sensor, electrical conduit means is provided between the vehicle speed sensor and a speedometer of the vehicle, and the switching means is connected to the vehicle speed sensor by tapping into the electrical conduit means leading to the speedometer in a retrofit configuration.

2. A simplified apparatus for positively preventing the use of mobile personal communication devices in vehicles as set forth in claim 1 wherein said switching means comprises a normally open switch connected by electrical conduit means between said motion responsive device and said signal jammer.

3. A simplified apparatus for positively preventing the use of mobile personal communication devices in vehicles as set forth in claim 1 wherein the signal jammer receives its power supply from the vehicle battery.

4. A simplified apparatus for positively preventing the use of mobile personal communication devices in vehicles as set forth in claim 1 wherein the signal jammer is adapted to selectively block signals in the vehicle.

5. A simplified apparatus for positively preventing the use of mobile personal communication devices by the operator of a vehicle; said apparatus comprising:

a motion responsive sensor in the vehicle, switching means operable by the sensor when the vehicle is in motion, a signal jammer operable by the switching means to block at least one of the incoming and outgoing signals associated with the personal mobile communication device when the vehicle is in motion, and a power supply associated with the signal jammer, wherein the apparatus is rendered tamper-proof by at least two of hiding, armoring, and duplicating its wiring.

* * * * *